US005626107A

United States Patent [19]

De Blasi

[11] Patent Number: 5,626,107

[45] Date of Patent: May 6, 1997

[54] VALVE SYSTEMS FOR INTERNAL COMBUSTION PISTON ENGINES

[76] Inventor: Italo De Blasi, R.R. #1, Manilla, Ontario, Canada, K0M 2J0

[21] Appl. No.: 560,452

[22] Filed: Nov. 17, 1995

[51] Int. Cl.[6] ..... F01L 7/02; F01L 7/16

[52] U.S. Cl. ..... 123/81 B; 123/190.17

[58] Field of Search ..... 123/81 R, 81 B, 123/190.17

[56] References Cited

U.S. PATENT DOCUMENTS

| | | | |
|---|---|---|---|
| 1,019,374 | 3/1912 | Shaw | 123/81 B |
| 1,083,208 | 12/1913 | Goodness | 123/81 B |
| 4,119,077 | 10/1978 | Vallejos | 123/81 B |
| 4,198,846 | 4/1980 | Rassey | 123/190.17 |
| 4,864,984 | 9/1989 | Blish | 123/190.2 |
| 4,949,686 | 8/1990 | Brusutti | 123/190.17 |
| 4,969,918 | 11/1990 | Taniguchi | 123/81 B |
| 4,976,227 | 12/1990 | Draper | 123/190.2 |
| 5,058,857 | 10/1991 | Hudson | 123/90.11 |

*Primary Examiner*—Erick R. Solis
*Attorney, Agent, or Firm*—Ridout & Maybee

[57] ABSTRACT

Valves for an internal combustion engine are mounted for rocking movements about an axis perpendicular to a cylinder axis of the engine, and define passage portions extending perpendicular to their rocking axes so that they move between positions in which their passage portions form part of venturi-shaped inlet and exhaust passages, and positions in which they obturate the inlet and exhaust passages. The valve members may be rocked by a camshaft and mechanical linkages, or by actuators under computer control.

8 Claims, 4 Drawing Sheets

FIG 4
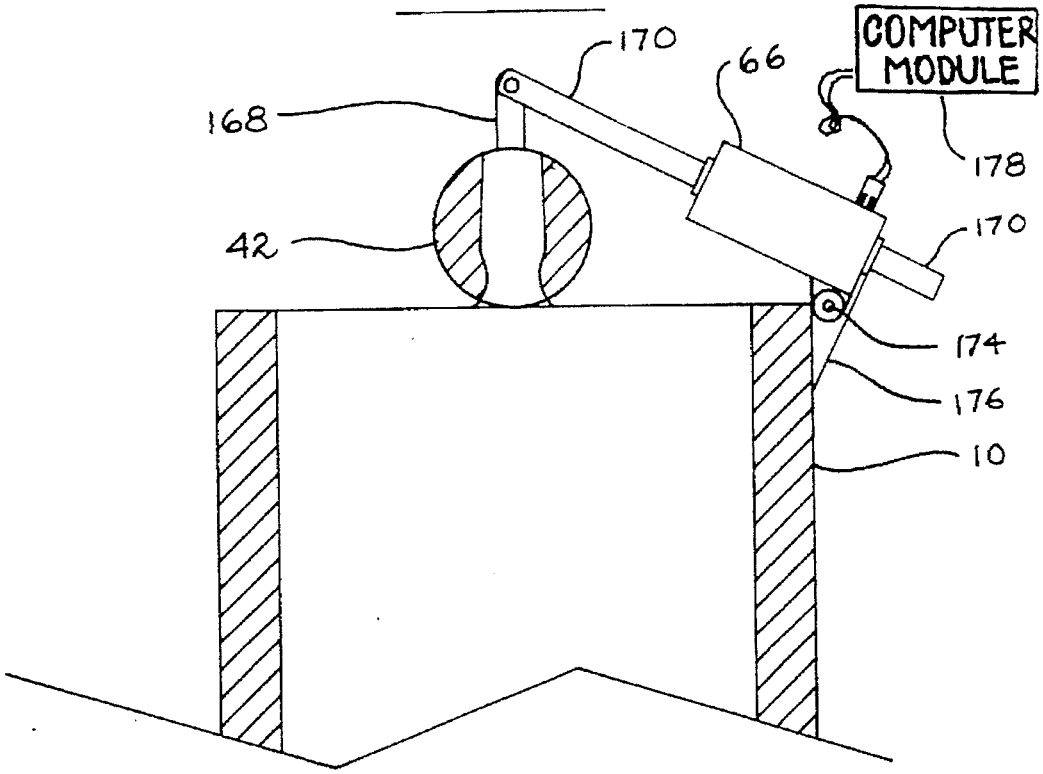
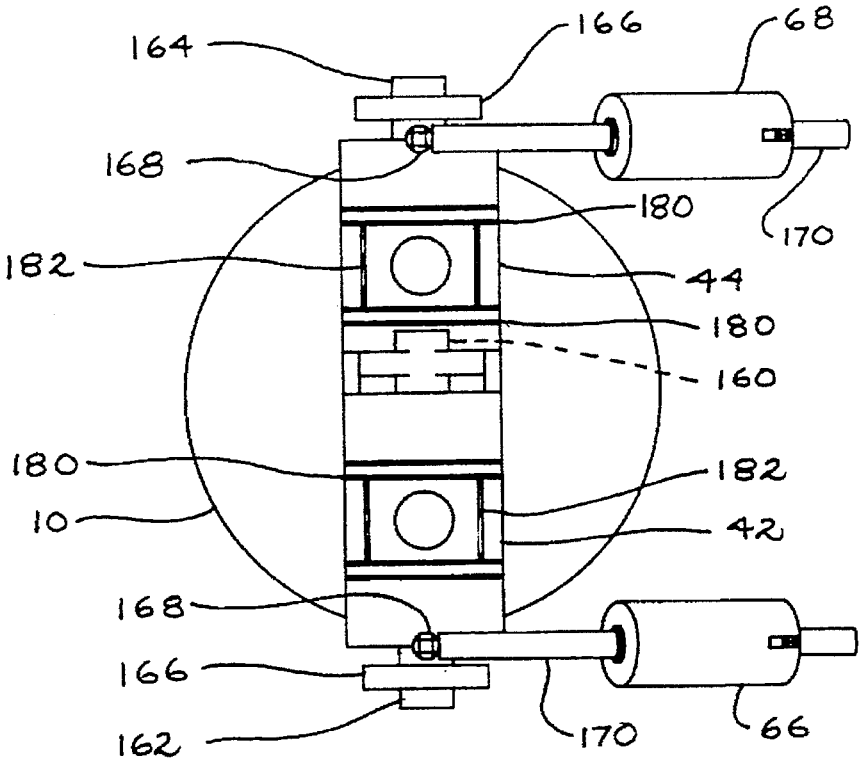
FIG 5

VALVE SYSTEMS FOR INTERNAL COMBUSTION PISTON ENGINES

FIELD OF THE INVENTION

This invention relates to valve systems for internal combustion piston engines.

BACKGROUND OF THE INVENTION

Such an engine commonly utilizes cam driven poppet valve to control inlet and exhaust of gases to and from the combustion chamber of the or each cylinder of the engine. Typically the timing of valve events in such an engine is fixed and hence a compromise, although the cam-driven poppet valve has the advantage that valve events can be varied over a wide range during design by varying the profile of the operating cam. Thus the timing and velocity of opening and closing and the dwell of the valve in its open position can be determined at the design stage. It is possible to provide for variable valve events in a popper valves system utilizing more or less complex drive mechanisms, and to provide for relatively rapid opening and closing of the valves, but the head and stem of poppet valve mechanism is of such a configuration as to stand in the way of optimally streamlined inlet and exhaust passages, and in practical embodiments protrudes when open into the combustion chamber of the cylinder which it controls. This may place design constraints on possible valve events if catastrophic failure through valve to piston contact is to be avoided. The reciprocating mass of the valve and the usual reliance upon springs to close place further constraints upon high speed operation if valves bounce or chatter is to be avoided.

Proposals have been made for rotary cylindrical or spherical valves, as exemplified by U.S. Pat. No. 5,361,739 and other earlier patents of George J. Coates. Such valves are driven by suitable gearing from the crankshaft of an engine of which they form part, and have the potential advantages of avoiding the use of reciprocating parts in the valve mechanism and permitting the provision of optimally shaped gas passage through the valve. In practice, however, the constant relationship of the rotational velocity of such valves to that of the engine they control places considerable constraints on design since the opening and closing velocity of the valve is constant, dwell in the fully open position can only be achieved by less than optimal valve passage shaping, and the shaping of the valve passage changes continuously while the valve is open. Little can be done to offset the relatively slow opening and closing of such a valve without seriously compromising valve passage design.

SUMMARY OF THE INVENTION

It is an object of the present invention to provide a valve mechanism capable of fully exploiting the improved gas passage configuration potentially offered by the rotary valve in its fully open condition, while retaining and even improving upon the design flexibility and opening and closing performance of the poppet valve.

The invention provides an internal combustion engine having at least one gas passage communicating with a combustion chamber, a normally closed valve in said passage, and a valve actuator for opening said valve during a portion of an operating cycle of the engine; wherein the valve is a member mounted for rocking movements about an axis transverse to said passage, the member defining a passage portion extending perpendicular to said axis, and wherein the valve actuator is operative to rock said valve member about said axis between a position in which said valve member obturates said passage, and a position in which said passage portion is aligned with said gas passage to form a venturi opening into said combustion chamber.

In one embodiment of the invention, the valve actuator is a camshaft driven by a crankshaft of the engine in conjunction with a drive linkage which may include such conventional elements such as lever arms, push rods, rocker arms, fixed or telescopic links, toggles and crank pins so as to translate the cam profile into a desired rocking movement of the valve member. Alternatively, the valve actuator may be driven independently of the crankshaft by a solenoid or fluid operated actuator, either providing linear reciprocating motion translated into reciprocatory angular rocking motion by a suitable linkage, or providing reciprocatory angular motion directly.

Further features of the invention will be apparent from the following description of exemplary embodiments thereof.

SHORT DESCRIPTION OF THE DRAWINGS

In the drawings:

FIGS. 4 and 5 are vertical sectional and plan views of components of a further embodiment of the invention, the cylinder head being omitted for clearer illustration.

DESCRIPTION OF THE PREFERRED EMBODIMENTS

The illustrated embodiments are directed to a simplistic single cylinder engine in order to illustrate the principles of the invention, but it will be appreciated that these are equally applicable to multi-cylinder engines. The illustrated embodiments also contemplate application of the invention to existing engine designs utilizing a replacement cylinder head assembly but engines designs could of course be designed specifically to facilitate application of the invention. The exemplary embodiments are shown applied to an engine having some similarity to the model CT 240 small engine from Honda, but this application is exemplary only.

Figure 1:
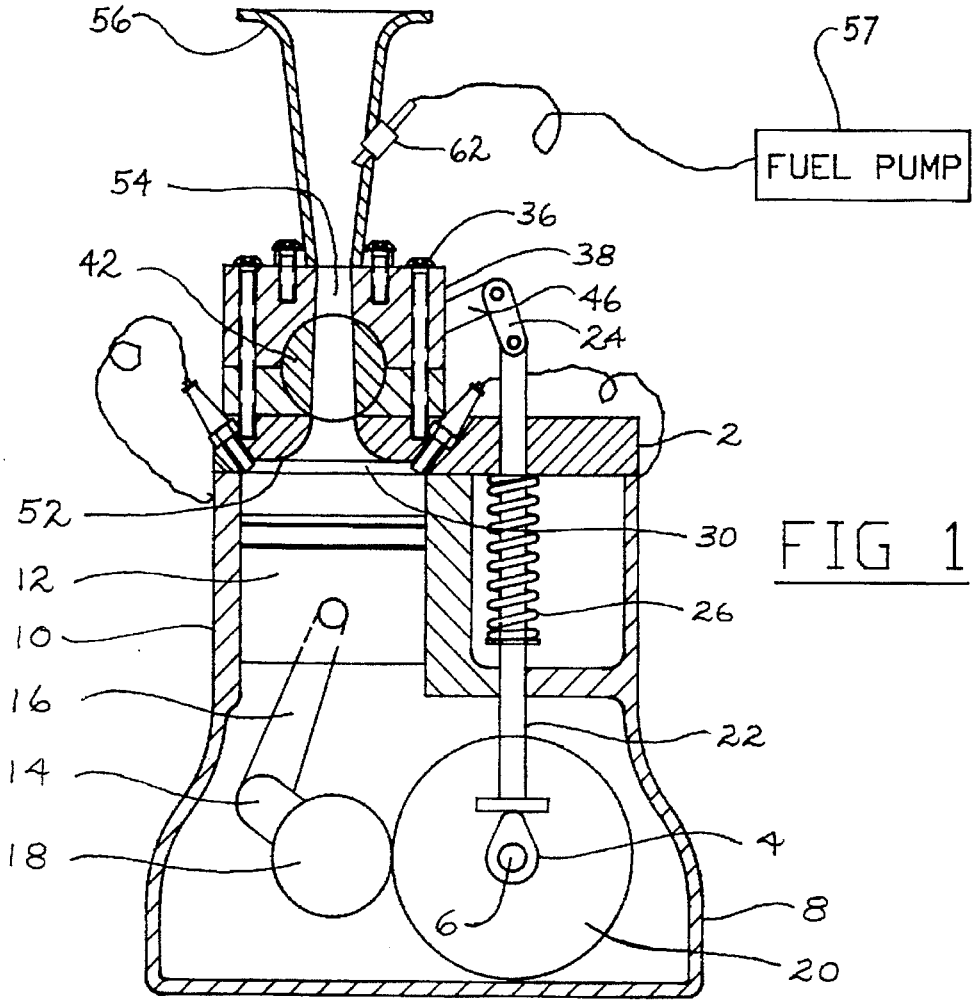
FIG. 1 is a vertical cross-section through an exemplary single cylinder four-stroke internal combustion engine modified to incorporate the invention.
Figure 2:
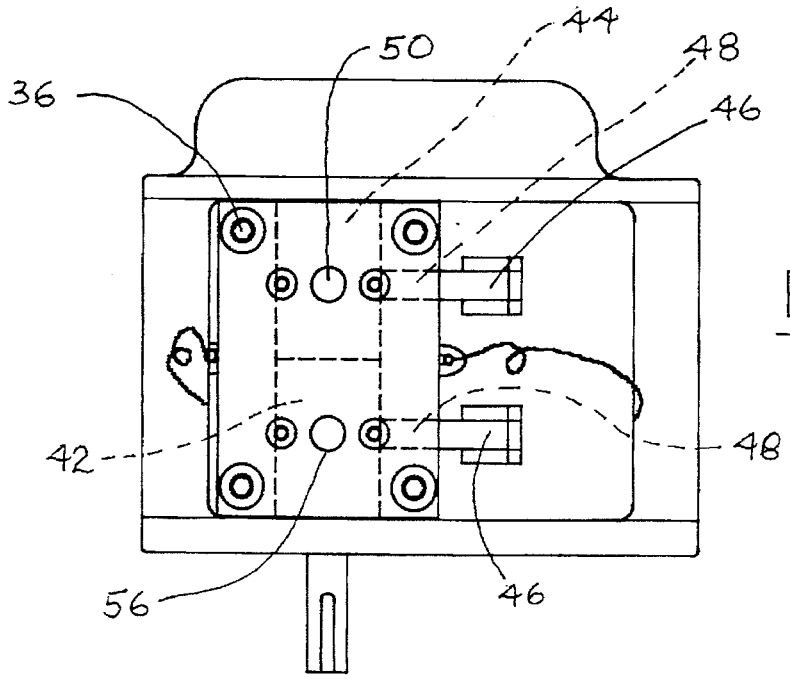
FIG. 2 is a plan view of the engine of FIG. 1.

Referring to FIG. 1, all parts of the engine shown beneath the cylinder head 2 are conventional, except that the profile of cams 4 on a camshaft 6 may be optimized for the present invention. Thus an engine casting define a crankcase 8 and a cylinder 10, a piston 12 drives a crankshaft 14 trough a piston rod 16, and the crankshaft 14 drives the camshaft 6 at half engine speed through gears 18 and 20. Push-rods 22 are modified at their upper end for pivotal connection to a rocker link 24, and are provided with return springs 26 to maintain them seated on the cams 4.

A cylinder head 28 defines a combustion chamber 30 equipped in the example shown with dual spark plugs 32. The springs 26 act between thrust rings 34 on the push rods and the head 28. A valve housing is mounted to the cylinder head by bolts 36, and comprises upper and lower portions 38 and 40 together defining a cylindrical chamber containing two axially aligned cylindrical valve members 42 and 44. The links 24 are pivotally connected to the end of crank arms 46 secured in diametrical slots 48 in end faces of the valve menders 42 and 44, such that the action of the cams 4 as the shaft 6 rotates rocks the valve members through a sufficient angle about their common cylindrical axis that they will each move, according to a timing set by the profile of each cam 4, between a closed position in which a passage portion 50 defined in each valve member does not align with passages 52 and 54 in the head 28 and the housing portion 38, and a position as shown in FIG. 1, in which the passage portion 50 aligns with the passages 52 and 54 in a streamlined manner to provide a smooth and unobstructed gas passage, which is preferably provided with a venturi profile. It should be noted that FIG. 1 shows an inlet passage and valve of the engine, but the cam and valve linkage is associated with the exhaust valve. The inlet port formed by the passage 50, 52 and 54 is fitted with an air trumpet 56 to optimize ram effect through the inlet passage, although necessity for air filters and intake silencing in many applications may require less than optimum connections to the air inlet passages. In the case of the exhaust valve, a suitable exhaust pipe (not shown) is attached to the passage 54. It would be possible to provide a duplicate exhaust passage and associated actuating mechanism to the other side of the inlet valve if desired to improve exhaust efficiency, and the inlet valve could also be duplicated. A fuel injector 62 may be mounted in the air trumpet, fed from a fuel pump 57

Figure 3:
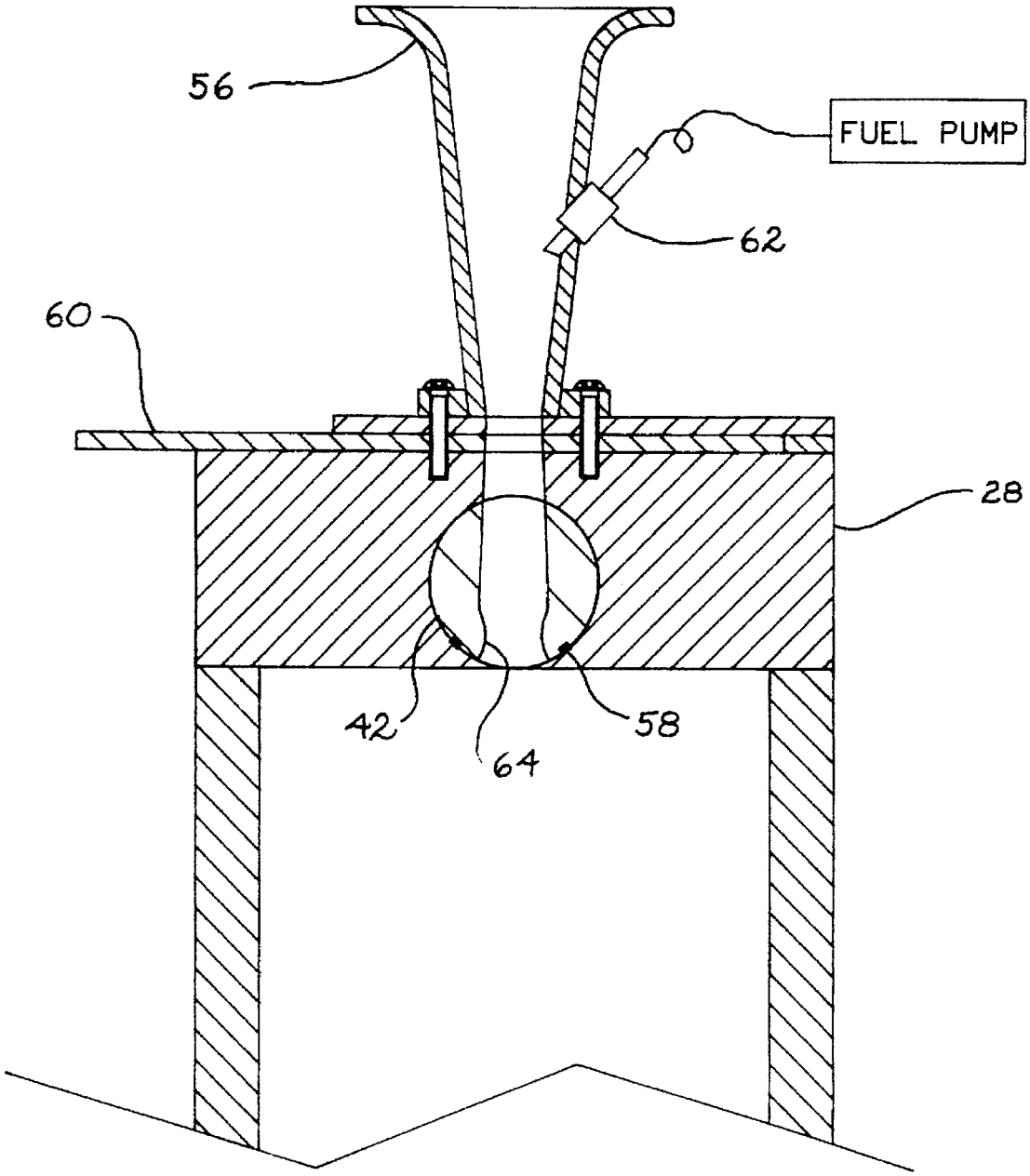
FIG. 3 illustrates in vertical section a modified cylinder head.

FIG. 3 shows a modified cylinder head arrangement, in which the separate valve housing is dispensed with, and the valve members 42 and 44 are located in a transverse bore within the head 28. The passage 30 opens directly into the combustion chamber, so there is no passage 52. Seals 58 are located in the valve members in engagement with the head, and oppositely acting throttle plates 60 are located for sliding motion between the head 28 and the air trumpet 56, which is shown equipped with a fuel injector 62. The passage portion 50 is shown as defining a more pronounced venturi 64 so as to optimize air flow through the valve of full throttle or near to full throttle conditions.

FIGS. 4 and 5 illustrate a modified valve actuating arrangement; for the sake of clearer illustration, the cylinder head, which is similar to that of FIG. 3, is not shown, and FIG. 5 also omits those portions of the engine beneath the head, and support structure for solenoids 66 and 68, only the position of the bore of the cylinder 10 being shown, although the opportunity is taken to show some additional features of the valve members 42 and 44. The valve members are mounted coaxially in a bore in the head (not shown), with a stub shaft 160 on the member 42 journalled in a bore in the member 44, stub shafts 162 and 164 on the members being supported in the head by bearings 166. Each member 42, 44 has a lever arm 168 projecting out of the head and pivotally connected to a plunger 170 of a double acting solenoid or fluid actuator 66 or 68 mounted to the engine block by a carrier 174 pivoted to a bracket 176. Each solenoid is actuated to rock its associated valve member under control of a driver circuit in a computer module 178 which receives and processes engine parameter data, so that valve timing and dwell can be continuously controlled to respond to engine conditions without the limitations and complexity imposed by a mechanical linkage driven directly from the engine. The force required to rock the valve is comparatively small since opening and closing forces on the valves are not substantially opposed by engine pressures. The valve members are provided with metallic or ceramic sealing rings 180 and wiper seals 182 to prevent leakage past the valves when closed. An alternative arrangement to eliminate the friction and problems associated with wiper seals is shown in FIGS. 6A and 6B.

Figure 6A:
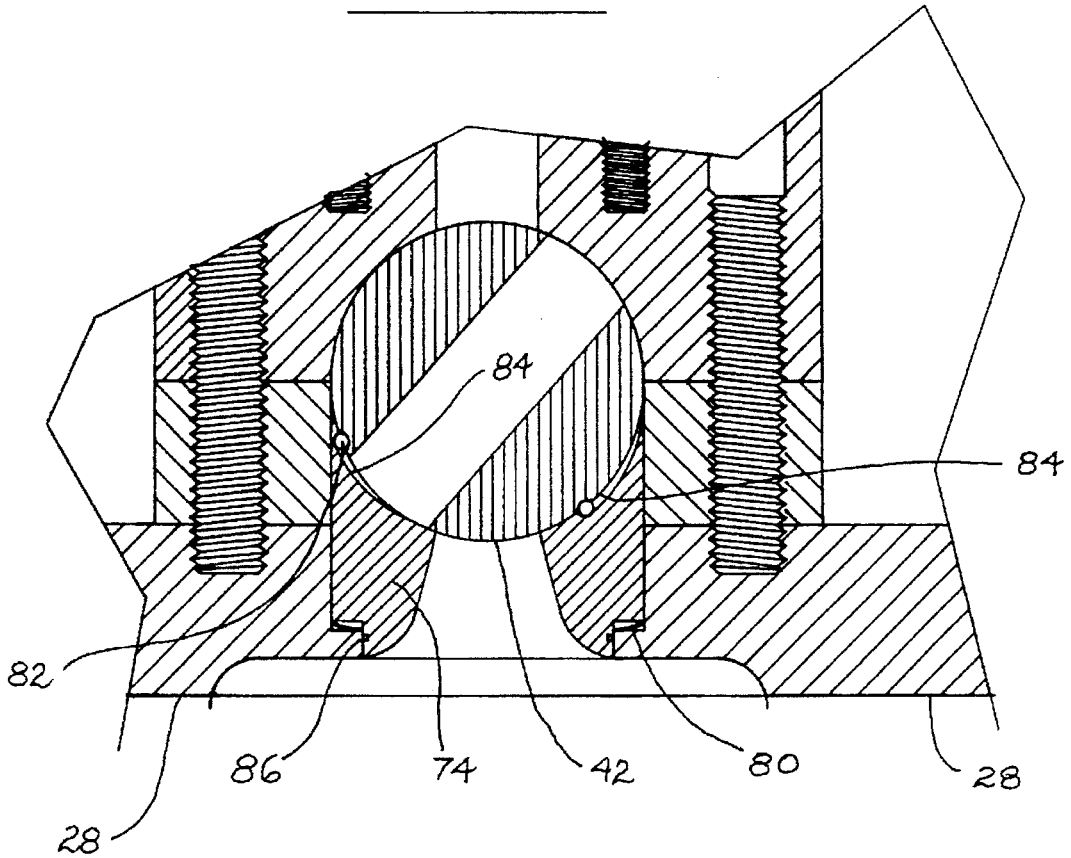
FIGS. 6A and 6B are fragmentary vertical sectional views showing an alternative embodiment of valve member and valve seat, in closed and open positions respectively.
Figure 6B:
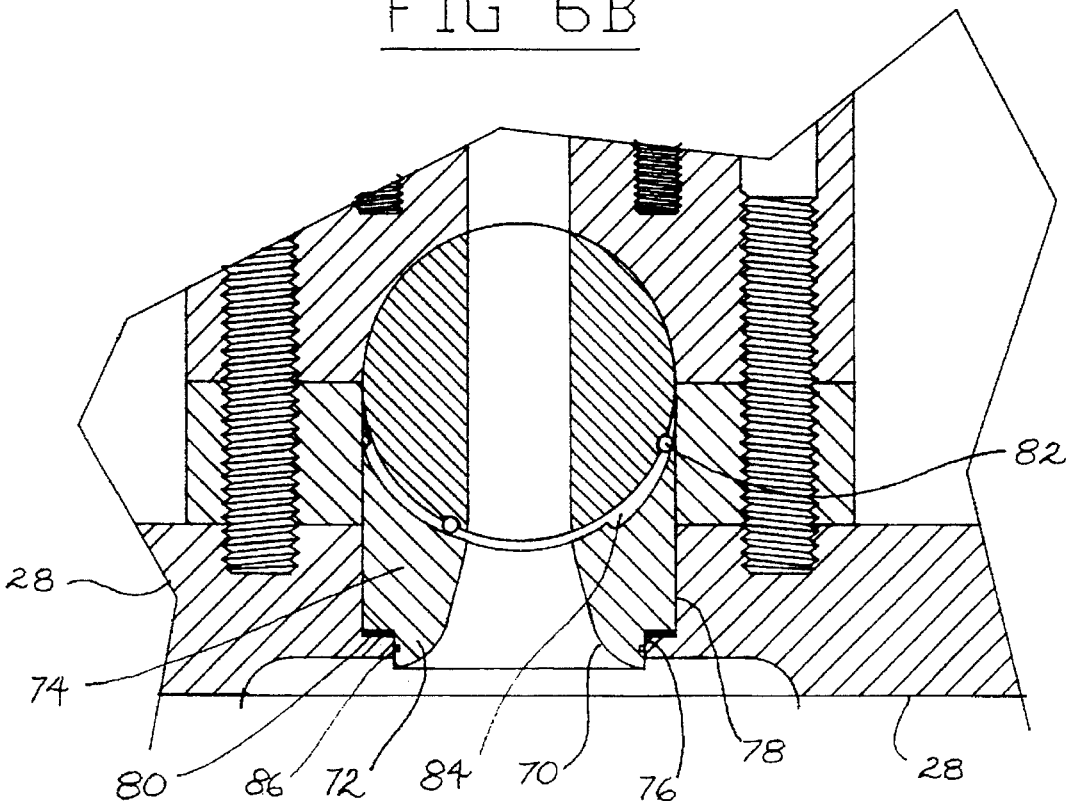

In FIGS. 6A and 6B, a valve member 42 (or 44 for an exhaust valve), is supported in the cylinder head 28 by a seat member 70, which has concentric cylindrical portions 72 and 74 movable vertically in bores 76 and 78 in the cylinder head. A sealing ring 86 is provided in a groove in the seat number 70. A spring, conveniently a belleville spring 80, acts between shoulders connecting the portion 72 and 76 and the bores 76 and 78 respectively to the seat against the meer 42. Ball bearings 82 are located in tapered grooves 84 in the member 42 so that during movement of the valve member between closed (FIG. 6A) and open (FIG. 6B) position, the seat member 70, was allowing free movement of the valve member while permitting a close seal in the closed position. In this latter position, cylinder pressure acting on the bottom of the member 70 will tend to maintain the seal.

I claim:

1. In an internal combustion engine having at least one gas passage communicating with a combustion chamber, a normally closed valve in said passage, and a valve actuator for opening said valve during a portion of an operating cycle of the engine, the valve being a member mounted for rocking movements about an axis transverse to said passage, the member defining a passage portion extending perpendicular to said axis, the improvement wherein the valve actuator is operative to rock said valve member about said axis between end positions in one of which said valve member obturates said passage, and in the other of which said passage portion is aligned with said gas passage, the passage portion and said gas passage conjointly defining, when aligned, a venturi opening into said combustion chamber.

2. An engine according to claim 1, wherein the valve actuator includes an engine driven camshaft and a linkage translating rotation of said camshaft into rocking movements of the valve member.

3. An engine according to claim 1, wherein the valve actuator is controlled independently of said engine by a computer module processing engine data.

4. An engine according to claim 3, wherein the valve actuator includes a solenoid controlled by said computer module and linked to said valve actuator.

5. An engine according to claim 1, having at least one inlet valve actuator and at least one exhaust valve actuator and associated gas passages associated herewith and communicating with the combustion chamber.

6. An engine according to claim 5, having a cylinder and a cylinder head defining the combustion chamber, wherein the valve members are cylindrical and located coaxially in a bore in the cylinder head extending perpendicular to a longitudinal axis of the cylinder.

7. An engine according to claim 6, wherein a valve seat defining a port from said valve member to said combustion chamber is located in the cylinder head between the valve member and the combustion chamber.

8. In an internal combustion engine having at least one gas passage communicating with a combustion chamber, a normally closed valve in the said passage, and a valve actuator for opening said valve during a portion of an operating cycle of the engine, the valve being a member mounted for rocking movements about an axis transverse to said passage, the member defining a passage portion extending perpendicular to said axis, the engine further having a cylinder and a cylinder head defining the combustion chamber, the valve members being cylindrical and located coaxially in a bore in the cylinder head extending perpendicular to a longitudinal axis of the cylinder, and a valve seat defining a port from said valve member to said combustion chamber located in the cylinder head between the valve member and the combustion chamber, the improvement wherein the valve actuator is operative to rock said valve member about said axis between a position in which said valve member obturates said passage, and a position in which said passage portion is aligned with said gas passage to form a venturi opening into said combustion chamber, and wherein the valve seat is spring urged towards the valve member by a spring acting between the cylinder head and the valve seat, and balls rolling in cam tracks defined between the valve member and the seat urge the valve seat and valve member out of contact as the valve member is rocked out of a closed position.

* * * * *